United States Patent [19]

Say

[11] 3,961,220

[45] June 1, 1976

[54] SNUBBER MEANS FOR POSITIONING A GUN STRUCTURE IN AN ELECTRON DISCHARGE DEVICE

[75] Inventor: Donald LeRoy Say, Waterloo, N.Y.

[73] Assignee: GTE Sylvania Incorporated, Stamford, Conn.

[22] Filed: May 16, 1975

[21] Appl. No.: 578,181

[52] U.S. Cl. ..... 313/417; 313/456

[51] Int. Cl.[2] ..... H01J 29/02; H01J 29/51; H01J 29/92

[58] Field of Search ..... 313/417, 412, 409, 413, 313/414, 482, 378

[56] References Cited

UNITED STATES PATENTS

| | | | |
|---|---|---|---|
| 2,400,331 | 5/1946 | Bachman | 313/482 |
| 3,315,109 | 4/1967 | Musselman | 313/378 |
| 3,441,769 | 4/1969 | Johnson | 313/412 |
| 3,544,826 | 12/1970 | McQueen et al. | 313/412 |

*Primary Examiner*—Robert Segal
*Attorney, Agent, or Firm*—Norman J. O'Malley; Frederick H. Rinn; Robert T. Orner

[57] ABSTRACT

Two or more self-adjusting electrical conductive snubber means are employed in an electron beam device to effect concentricity of the electron gun structure within an encompassing portion of the envelope. Each of the snubbers is a longitudinal resilient metallic member fabricated of flat material and formed for placement on an electrode of the gun structure in an orientation normal to the axis thereof. The central portion of each snubber is an attachment area having like transition portions formed at each end thereof, wherefrom similar resilient lever arms extend in an opposed longitudinal manner, each having a contact element terminally formed thereon. In usage, each of the lever arms is flexed from a relaxed to a compressed position within the envelope in a manner tangential to the positioning electrode to provide an accommodating fulcrum therewith. This self-adjusting fulcrum effects increased pressured placement of each contact element against the surface of the related envelope portion thereby providing concentricity of the gun structure therein.

10 Claims, 12 Drawing Figures

SNUBBER MEANS FOR POSITIONING A GUN STRUCTURE IN AN ELECTRON DISCHARGE DEVICE

BACKGROUND OF THE INVENTION

This invention relates to electron beam devices and more particularly to means for effecting concentricity of a multi-electrode beam generating means within an encompassing portion of the envelopic enclosure thereof.

In electron beam devices, for example cathode ray tubes employed in image display devices such as television applications, resilient-type spacer positioners or snubber supports are conventionally utilized to space and align the electron generating and controlling assembly, or electron gun structure, within the neck portion of the enclosing envelope. Usually, three or more of these longitudinally-formed resilient snubber members are attached to the terminal electrode structure of the beam generating means, in a manner to extend forward and outward thereof, to contact the sidewall of the encompassing neck portion. These forwardly oriented projecting snubbers are intended to not only effect a degree of lateral support for the electron gun, but also provide an electrical connection between the gun structure and the electrical conductive coating commonly disposed on the interior surface of the funnel portion and extended therefrom into the neck portion to the region adjacent the forward part of the electron gun structure. It has been found that such forwardly extending snubbers, because of their lengthy resilient support arms and the individual placement thereof, provide a degree of concentric support for the electron gun structure that is often less than desired. Under certain shock conditions, the length of these protruding positioning members is apt to allow relative lateral motion of the electron gun with respect to the encompassing envelope. As a consequence, the alignment of the gun within the envelope may be temporarily out of specification, or possibly permanently misaligned, thereby detrimentally affecting the operational characteristics of the tube. Color cathode ray tubes in particular require precision alignment of the electron gun structure relative to the mask openings and the associated patterned screen. Therefore, it is prerequisite that the electron gun structure be concentrically aligned and maintained as such to insure optimum tube performance. Furthermore, particularly in short neck tubes, the forwardly oriented snubbers are apt to extend into a region critical to the desired operation of the tube, such as protruding into the yoke field, or be positioned so that they may become heated during getter flashing, or be oriented in a manner to effect shadowing of one or more of the electron beams closely passing thereby.

OBJECTS AND SUMMARY OF THE INVENTION

It is an object of the invention to reduce and obviate the aforementioned disadvantages evidenced in the prior art by providing an improvement in the form of self-centering electrical conductive snubber means for use in an electron beam device to effect concentricity of the electron beam generating means within an encompassing portion of the tube envelope. Another object is the provision of electrical conductive snubber means that are self-adjusting relative to the minimum and maximum internal dimensionings of the encompassing portion of the envelope. A further object is the provision of electrical conductive snubber means that effect positive pressured electrical contact with the coating disposed on the internal surface of the encompassing envelope portion; and an additional object is the provision of electrical conductive snubber means that provide both ruggedized and concentric support for the electron beam generating means within the neck portion of the tube.

These and other objects and advantages are achieved in one aspect of the invention by the provision of electrical conductive snubber means for utilization in an electron beam device to effect concentricity of the multi-electrode beam generating means within an encompassing portion of the envelope. Each of the snubber means is a longitudinal resilient metallic member fabricated of flat material and formed for placement on an electrode element of the beam generating means. Each of the snubber members has a central attachment portion shaped to correspond substantially to the periphery of the electrode member of the generating means to which it is attached. On either side of the attachment portion are like transition portions from which similar lever arm portions extend in an opposed longitudinal manner. Terminally formed on each of the lever portions is an integral contact element. In utilization, at least two of these electrical conductive snubber means are affixed to the snubber positioning electrode element in an orientation normal to the longitudinal axis of the electron generating means. Each of the lever arms is positionally flexed from an as-formed relaxed position to a compressed position within the envelope portion in a manner tangential to the associated electrode. Thus, each lever portion is provided with an accommodating fulcrum to effect increased pressured placement of each respective contact element against the interior surface of the envelope.

Figure 1:
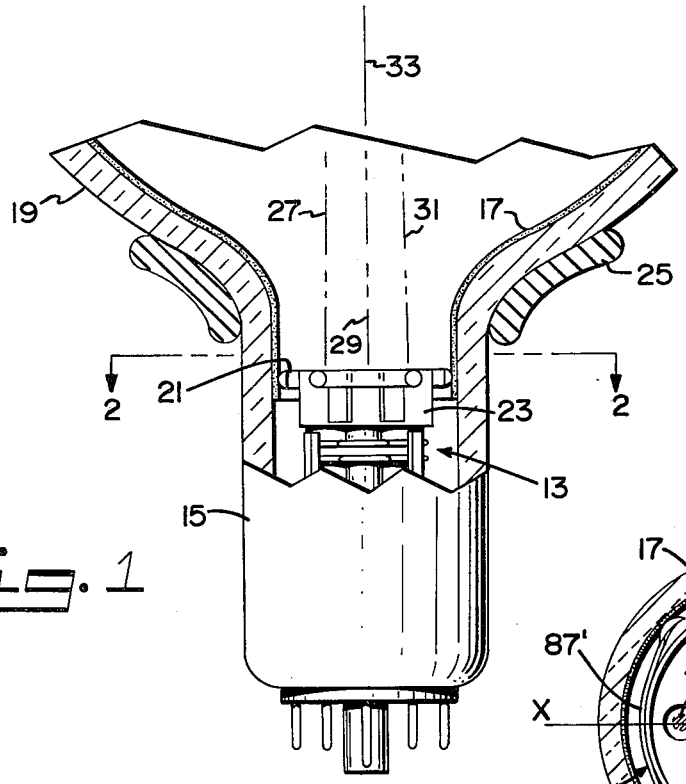
FIG. 1 is a partially sectioned view of a portion of a cathode ray tube illustrating utilization of the invention therein.
Figure 6B:
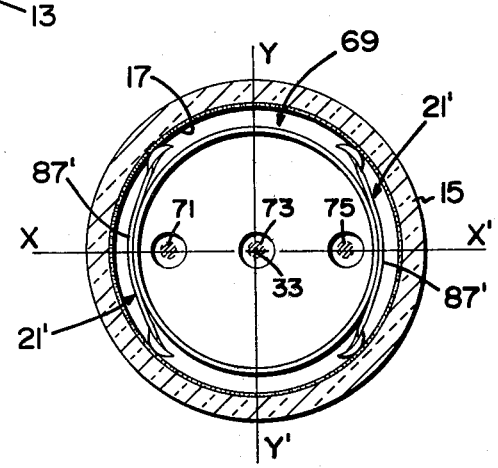
Figure 6A:
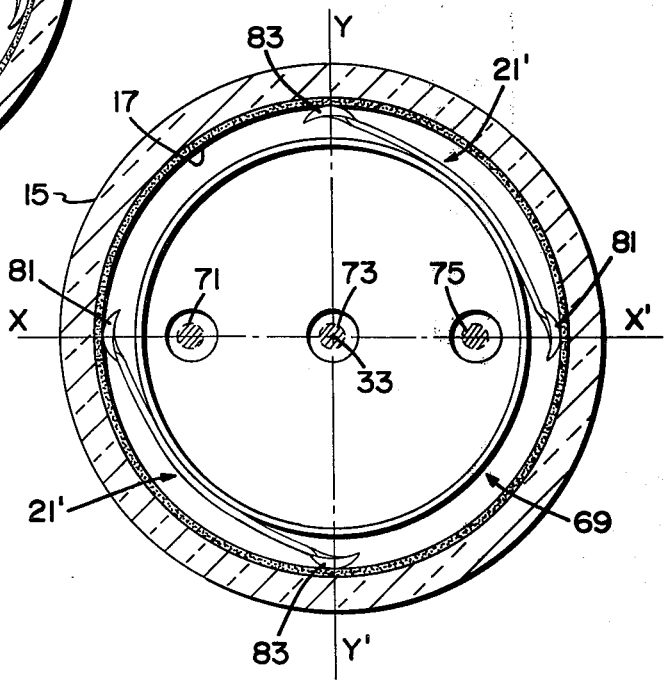
Figure 5:
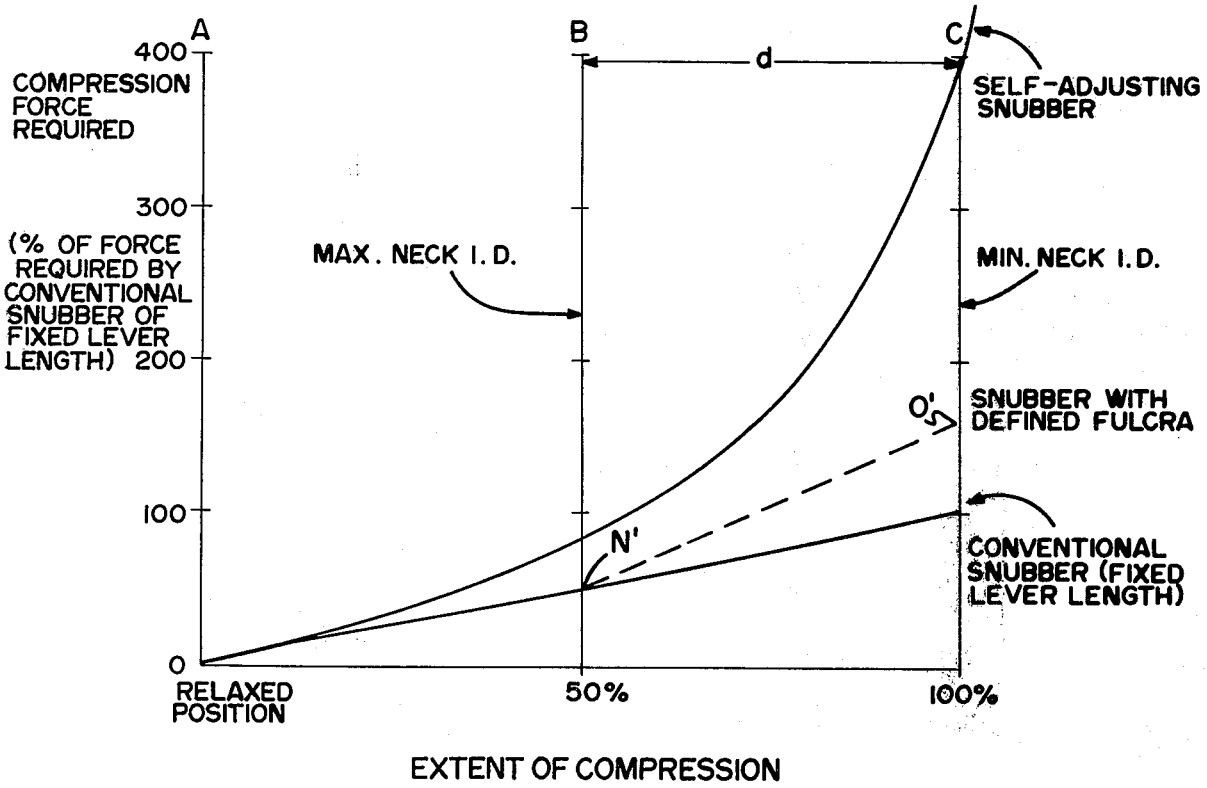

FI. 4 is an edge view of one embodiment of the electrical conductive snubber means of the invention;

FIG. 5 is a chart illustrating the compressive advantages effected by the snubber means of the invention;

FIGS. 6A and 6B are plan views illustrating other embodiments of the invention as utilized on a plural beam inline electron gun taken along a line 2—2 orientation as generally noted in FIG. 1; and FIGS. 7 through 11 are illustrative delineating, additional, exemplary embodiments of the snubber means of the invention.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

While the broad concept of the invention relates to snubber means for use in an electron beam device to effect concentricity of the multi-electrode beam generating means within an encompassing portion of the envelope, the ensuing description is primarily directed to exemplary employment of the invention in a color cathode ray tube application.

With reference to the drawings, FIG. 1 illustrates a partially sectioned view of a cathode ray tube 11, wherein a multi-electrode plural beam electron gun structure 13 is oriented within the neck portion 15 of the tube envelope. The electrical conductive coating 17 disposed on the interior surface of the funnel portion 19 is extended into the forward region of the neck portion, whereat electrical connection is made with the several snubber means 21 oriented on the terminal electrode 23 of the electron gun structure.

A yoke member 25 is exteriorly mounted on the tube envelope in substantially the jointure region between the funnel 19 and the neck 15 portions thereof. As illustrated in FIG. 1, the snubber means of the invention 21 do not protrude into the field of the yoke, nor do they in any manner interfere with the plural electron beams 27, 29, and 31 emanating from the electron gun structure.

Figure 2:
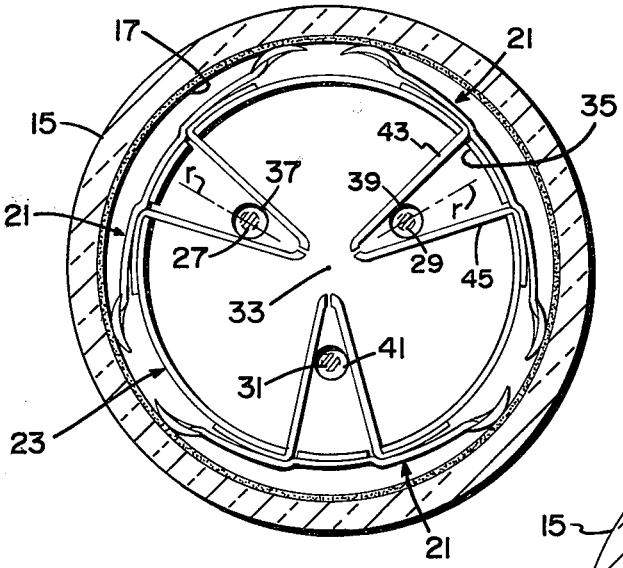
FIG. 2 is a plan view illustrating employment of the invention taken along the line 2—2 of FIG. 1.

The terminal electrode 23, to which the snubber means 21 are attached, is further delineated in FIG. 2. In this instance, it is a magnetic convergence electrode having a longitudinal axis 33 and three beam apertures 37, 39 and 41 therein to accommodate the traversal of a substantially delta arrangement of three separate electron beams therethrough. This terminal electrode 23 of substantially cylindrical shaping is concentrically oriented within a substantially cylindrical encompassing neck portion 15 of the envelope by three spaced apart like snubber means 21, being affixed thereto in an orientation normal to the longitudinal axis 33. Each of the three snubber means is attached to the electrode in substantially radial alignment *r* with a respective beam traversing aperture. In each case, the area of attachment 35 is a cylindrical portion of the electrode 23 between the pole pieces 43 and 45 associated with a respective beam, as for example 29.

Figure 3:
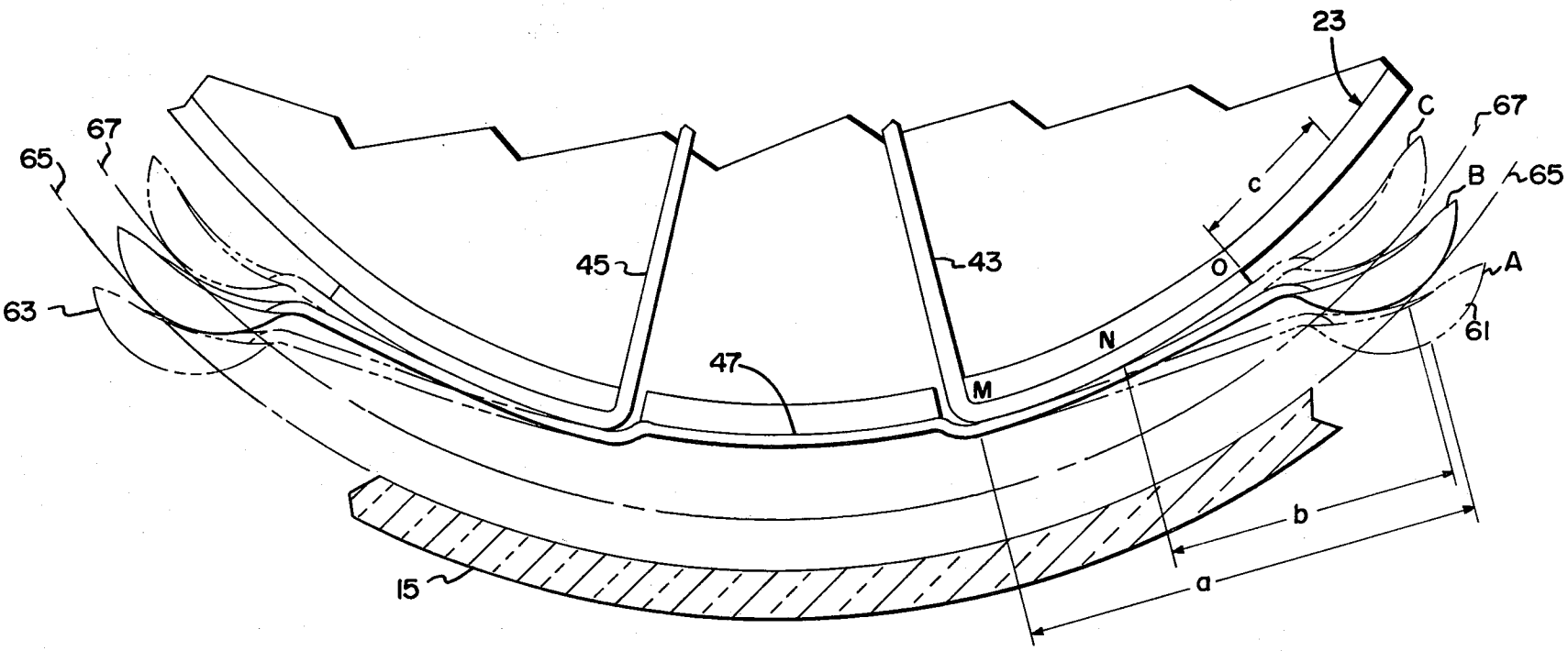
FIG. 3 is an enlarged plan view of a partial section of FIG. 2 illustrating the orientation and function of the invention.
Figure 4:
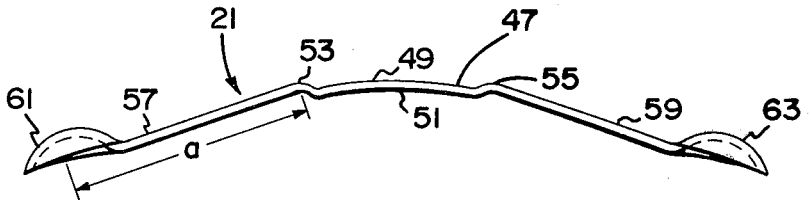

To expedite further detailed description of the invention, attention is additionally directed to FIGS. 3 and 4. In FIG. 4, the electrical snubber means 21 of the invention is delineated as being a longitudinal resilient metallic member fabricated of flat material and formed for circumferential placement on the terminal positioning electrode 23 of the electron gun. The central attachment portion 47 of the snubber means is of an arcuate shaping having opposed convex 49 and concave 51 surfaces; whereof the concave surface corresponds substantially to the circumferential periphery of the attachment area 35 of the cylindrical terminal electrode 23 upon which the snubber means is affixed. Like transition portions 53 and 55 are formed at each end of the central attachment portion to accommodatingly fit around the shoulders of the pole pieces 43 and 45. Similar first and second resilient lever arm portions, 57 and 59 respectively, are integrally formed with each of the respective transition portions and are extended therefrom in an opposed longitudinal manner. Each of the lever arms has a contact element terminally formed thereon. As shown, each of these contact elements 61 and 63 is configurated as a substantially spoon-shaped formation having a substantially convex exterior surface. It is to be noted that the convex surface of each spoon 61 and 63 and the convex surface of the central arcuately formed attachment portion 47 are oriented in a substantially common general direction. The snubber means in its relaxed as-formed condition evidences substantially straight resilient lever arm portions, each having, for example, a primary effective initial length of *a*. The transition portions 53 and 55 which individually join the respective lever arms 57 and 59 to the respective ends of the central attachment portion 47, are of similar shapings having radii differing from that effecting the arcuate shaping of the attachment portion. Thus, the like shapings of the transition portions alter the directional placement of the extending lever arms 57 and 59 from the arcuate curvature of the attachment portion 47.

Utilization of the snubber means of the invention as shown in FIGS. 1 and 2, is further detailed in FIG. 3 wherein the maximum 65 and minimum 67 internal dimensionings of the encompassing neck portion 15 are shown. The internal coating 17 is eliminated for purposes of clarity. During tube fabrication, when the electron gun structure 13 is inserted into and oriented within the neck portion of the tube, each of the lever arms, 57 and 59, is positionally flexed from the as-formed relaxed position to a compressed position as required by the internal dimensioning of the neck. This compressed positioning, as effected substantially within the lever arm, initiates a conforming relationship with the cylindrical electrode in a tangential manner to provide an accommodating fulcrum therewith. Within the range of maximum to minimum neck dimensionings, this relationship effectively shortens the lever arm and results in increased pressured placement of each respective contact element against the interior surface of the adjacent neck portion. By way of example, placement of each contact element 61 and 63 against the interior surface of the neck having maximum internal dimensioning, (max. I.D.) as indicated by 65, shifts the tangential contact of the lever portion along the curved surface of the contiguous electrode, whereupon the lever arm is effectively shortened, as indicated by *b*, such being resultant of movement of the fulcrum, from M to N therealong toward the terminal contact element. Thus, a lever arm having a primary length of *a*, when employed within a neck of max. I.D. effects substantially fifty percent compressed flexure of each arm from its respective relaxed position, such being indicated, for example, by the shift of the contact portion from phantomed position A to position B in FIG. 3. When the neck portion has minimum internal dimensioning, (min. I.D.) as indicated by 67, the tangential contact between the lever and the associated electrode surface shifts further outward, thereby additionally shortening the lever to *c*, by moving the fulcrum from N to O therealong to substantially the region of the contact element 61. Such placement effects substantially full compressed flexure of each lever arm from its respective relaxed position, such being indicated in phantom as position C. Thus, the snubber means 21 of the invention provides a significant advance in the art in that the bending of each lever arm shortens as it is accommodated around the circumference of the electrode. The resultant shortening of the lever arm effects an increased compressive force between each contact element and surface of the surrounding neck. This self-adjusting action tends to insure an equalizing compression among the plurality of snubber means utilized thereby producing a concentric positioning of the electron gun structure within the encompassing neck portion.

Attention is directed to the chart shown in FIG. 5 wherein the compressive advantages of the self-adjusting snubber means are set forth. To provide a basis for comparison, a conventional snubber, that is one having a fixed lever length, and commonly oriented as projecting in the forward direction, is shown to exhibit a substantially linear relationship between the extent of compression and the compression force required. In comparison therewith, the self-adjusting snubber of the invention utilizes an accommodating fulcrum, the tangential position of which is determined by the cylindrical surface of the associated electrode 23 and the internal dimensioning of the encompassing neck 15. By way of example, three lever positions are shown: A — the relaxed or as-formed position, B — the 50% compression position, and C — the full compression position. These relate to the positionings shown in FIG. 3. The distance between the maximum neck I.D. 65 and lever portion B and the minimum neck I.D. 67 and lever position C, is represented by *d* in FIG. 5. In the working range between the B and C positions, the required compression force increases drastically in comparison to what is required for a conventional snubber of fixed lever length. As shown in FIG. 3, the exemplary lever position A has an arm length *a*, lever position B has reduced arm length *b* which is a value of substantially 0.63 *a*, and lever position C has a further reduced length *c* which is substantially 0.26 *a*. Thus, in comparison with a conventional fixed-length snubber under 100% compression, the self-adjusting snubber of the invention will exert a compression force of 100/0.26 or 384 percent.

Another utilization of the invention is shown in FIG. 6A, wherein two spaced-apart snubber means 21' are employed to effect concentric positioning of an electron gun structure 69 having a plurality of beams 71, 73 and 75 in an in-line arrangement. The view point is similar to that evidenced from a line of 2—2 orientation as generally noted in FIG. 1. Preferentially, the inline arrangement of the three beams coincides with the *x—x'* axis of *x* and *y* co-ordinates formed normal to longitudinal axis 33 of the beam generating means. As exemplarily shown, each of the two snubber means 21' employed has a contact element 81 oriented on the *x—x'* axis whereupon the opposed contact element 83 of each snubber means is on the *y—y'* axis. It has been found that a snubber arrangement of this orientation corresponding with the *x* and *y* co-ordinates provides for the expeditious achievement of the desired concentricity of the in-line electron gun structure 69 within the encompassing neck 15.

While the foregoing embodiment is considered preferential in an in-line beam structure, an example of another useful arrangement for orienting two snubber means 21' on an electron gun structure 69 having in-line arranged beams 71, 73 and 75, is illustrated in FIG. 6B. In this embodiment, each of the opposedly oriented snubber means 21' has its respective attachment portion 87' located on substantially the *x—x'* axis. Thus, the contact elements of each snubber means are substantially symmetrically positioned on either side of said *x—x'* axis.

Figure 7:
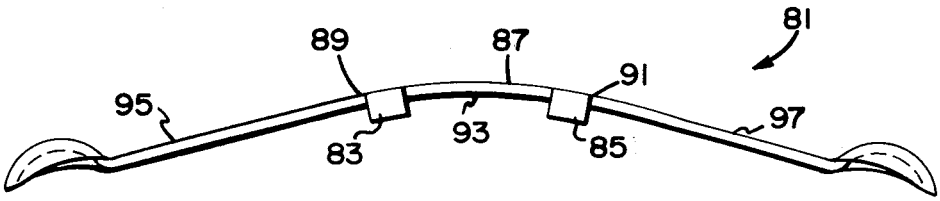
Figure 8:
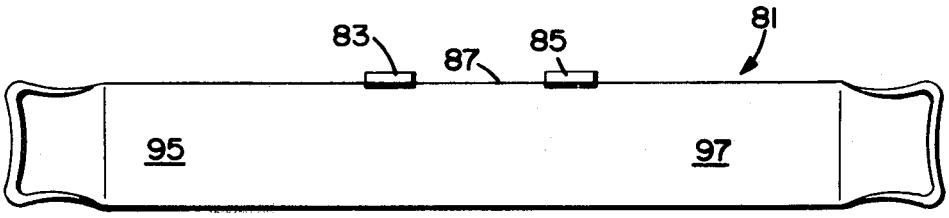

Another embodiment of the snubber means is shown in FIGS. 7 and 8. In this modification 81, two tabular elements 83 and 85 are formed as appendages to the arcuate attachment portion 87 at the transition regions 89 and 91. Such are formed in a manner outstanding from a side or edge thereof as a ledge or tab extending inward from the concave surface 93 to provide a seating stop for facilitating placement of the snubber means on the positioning electrode of the gun structure. These seating tabular elements facilitate positive placement of the snubber means against either the top or the bottom of the electrode member. In this embodiment the transition regions 89 and 91 are less pronounced, at either end of the attachment portion 87. The lever arms 95 and 97 extend in opposed directions as oriented in the first embodiment.

Figure 9:
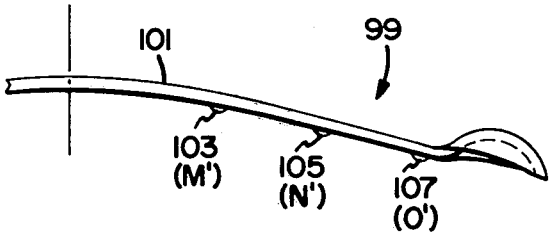
Figure 10:
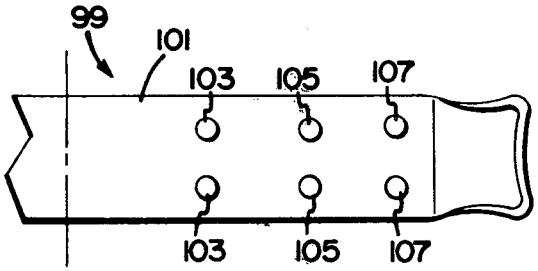
Figure 11:
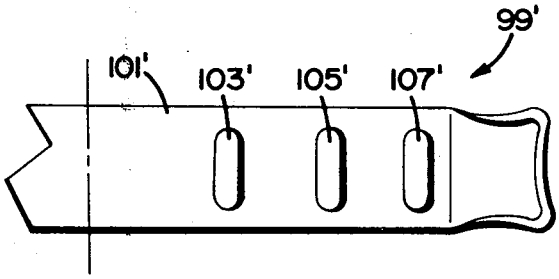

Another embodiment of the snubber means is illustrated by the modifications shown in FIGS. 9, 10 and 11 wherein only one of the lever arms is delineated. In referring to the structure 99, each of the like lever arm portions 101 and 101' has a plurality of longitudinally spaced apart protuberance means 103, 105 and 107 predeterminately formed thereon to define a series of sequent fulcra M', N', and O' which are similar to points M, N and O as shown in FIG. 3. In utilization, these protuberances are oriented to make defined contact with the related electrode surface, thereby providing specific fulcra for effecting accommodating lever portions of required characteristics during subsequent employment. As illustrated in FIG. 10, these protuberance means 103, 105 and 107 are in the form of longitudinally spaced apart pairs of laterally oriented dimples. A modification is shown in FIG. 11 wherein the protuberance means 103', 105'0 and 107' are longitudinally spaced apart as laterally formed bumps. The effects of the defined fulcra embodiment are indicated in FIG. 5.

Thus, there is provided an advantageous electrical conductive snubber means for use in an electron beam device to effect concentricity of the electron beam generating means within an encompassing portion of the envelope. Such snubber means are self-adjusting relative to the minimum and maximum internal dimensionings of the encompassing envelope. As such they provide positive pressured contact with the internal surface of the encompassing envelope, or coating disposed thereon, thereby effecting both ruggedized and concentric support for the electron gun structure.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube utilizing a multielectrode electron beam generating means employing a substantially cylindrical snubber positioning electrode accommodating the traversal of at least one electron beam and having a longitudinal axis therethrough, said generating means being oriented within a substantially cylindrical encompassing neck portion of the envelopic enclosure having minimum and maximum internal dimensions, means for effecting concentric positioning of said beam generating means within said neck portion comprising:

at least two electrical conductive snubber means in the form of similar longitudinal resilient metallic members fabricated of flat material and spatially positioned on said snubber positioning electrode, each of said snubber members having a central attachment portion formed in an arcuate manner to substantially conform to the circumferential surface of said positioning electrode whereon it is affixed in an orientation normal to said longitudinal axis, said attachment portion of each snubber means having like transition portions formed at each end thereof to provide like fulcra wherefrom similar first and second resilient lever arm portions extend in an opposed longitudinal manner, each of said lever portions having an integral contact element terminally formed thereon as a substantially spoon-shaped configuration having a convex exterior surface oriented to make contact with said neck portion, each of said lever arms being positionally flexed from an as-formed relaxed position to a compressed position within said neck portion in a manner tangential to said cylindrical electrode to provide a like accommodating fulcrum therewith and thence effect similar increased pressured placement of each respective integral contact element against the interior surface of the encompassing neck portion.

2. Means for effecting the concentric positioning of said electron beam generating means within the envelope neck portion according to claim 1 wherein placement of each contact element against the neck portion having maximum internal dimensioning shifts the tangential contact between the lever portion and said electrode thereby shortening said lever by moving the fulcrum thereof toward the contact element to effect substantially a fifty percent compressed-flexure of each lever arm from its respective relaxed position.

3. Means for effecting the concentric positioning of said electron beam generating means within the envelope neck portion according to claim 1 wherein placement of each contact portion against the neck portion having minimum internal dimensioning shifts the tangential contact between the lever portion and said electrode thereby shortening said lever by moving the fulcrum to substantially the contact element to effect substantially full compressed flexure of each lever arm from its respective relaxed position.

4. Means for effecting the concentric positioning of said electron beam generating means within the envelope neck portion according to claim 1 wherein said beam generating means is of the type producing three separate beams in a delta arrangement about said axis, and whereof three spaced-apart snubber means are employed to effect said concentric positioning, each of said snubber means having its attachment portion in substantially radial alignment with a respective beam traversing said snubber positioning electrode.

5. Means for effecting the concentric positioning of said electron beam generating means within the envelope neck portion according to claim 1 wherein said beam generating means is of the type producing three separate beams in an in-line arrangement wherein the three beams coincide with the $x—x'$ axis of $x$ and $y$ co-ordinates formed normal to said longitudinal axis of the beam generating means, and whereof two oppositely spaced-apart snubber means are employed to effect said concentric positioning, each of said snubber means having a contact element oriented on substantially said $x—x'$ axis whereupon the opposed contact element of each snubber is located on substantially said $y—y'$ axis.

6. Means for effecting the concentric positioning of said electron beam generating means within the envelope neck portion according to claim 1 wherein said beam generating means is of the type producing three separate beams in an in-line arrangement wherein the three beams coincide with the $x—x'$ axis of $x$ and $y$ co-ordinates formed normal to said longitudinal axis of the beam generating means, and whereof two oppositely spaced-apart snubber means are employed to effect said concentric positioning, each of said snubber means having its attachment portion oriented on substantially said $x—x'$ axis whereupon the contact elements of each snubber means are substantially symmetrically positioned on either side of said $x—x'$ axis.

7. The means for effecting the concentric positioning of said electron beam generating means within the neck envelope portion according to claim 1 wherein each of said lever arm portions has a plurality of longitudinally spaced-apart protuberance means predeterminately formed thereon to define a series of sequent fulcra oriented to contact said related electrode for effecting accommodating lever portions of required characteristics during utilization.

8. The means for effecting the concentric positioning of said electron beam generating means within the neck envelope portion according to claim 7 wherein said protuberance means are in the form of longitudinally spaced-apart pairs of laterally oriented dimples.

9. The means for effecting the concentric positioning of said electron beam generating means within the neck envelope portion according to claim 7 wherein said protuberance means are longitudinally spaced-apart laterally formed bumps.

10. The means for effecting the concentric positioning of said electron beam generating means within the neck envelope portion according to claim 1 wherein at last one tabular element is formed as an appendage to said attachment portion in a manner outstanding from a side thereof as a ledge extending inward from the concave surface to provide a seating stop for facilitating placement of said snubber means on said electrode.

* * * * *

UNITED STATES PATENT AND TRADEMARK OFFICE

CERTIFICATE OF CORRECTION

PATENT NO. : 3,961,220

DATED : June 1, 1976

INVENTOR(S) : Donald LeRoy Say

It is certified that error appears in the above-identified patent and that said Letters Patent are hereby corrected as shown below:

Col. 8, Claim 10, line 48: "last" should read --- least ---

Signed and Sealed this

Twelfth Day of October 1976

[SEAL]

*Attest:*

RUTH C. MASON
*Attesting Officer*

C. MARSHALL DANN
*Commissioner of Patents and Trademarks*